US007222428B2

(12) United States Patent
Koike

(10) Patent No.: US 7,222,428 B2
(45) Date of Patent: May 29, 2007

(54) ELECTRIC ROTARY SHAVER

(75) Inventor: Hideaki Koike, Matsumoto (JP)

(73) Assignee: Izumi Products Company, Nagano (JP)

( * ) Notice: Subject to any disclaimer, the term of this patent is extended or adjusted under 35 U.S.C. 154(b) by 55 days.

(21) Appl. No.: 11/232,355

(22) Filed: Sep. 21, 2005

(65) Prior Publication Data

US 2006/0059690 A1 Mar. 23, 2006

(30) Foreign Application Priority Data

Sep. 21, 2004 (JP) ..... 2004-273727

(51) Int. Cl.
*B26B 19/04* (2006.01)
*B26B 19/14* (2006.01)

(52) U.S. Cl. ..... 30/43.5; 30/74; 30/346.51

(58) Field of Classification Search ..... 30/43.4, 30/43.5, 43.6, 74, 346.51
See application file for complete search history.

(56) References Cited

U.S. PATENT DOCUMENTS

| | | | | |
|---|---|---|---|---|
| 3,116,551 | A * | 1/1964 | Anton | 30/43.6 |
| 3,844,033 | A * | 10/1974 | Yonkers | 30/43.5 |
| 3,913,225 | A * | 10/1975 | Tietjens et al. | 30/43.6 |
| 4,001,932 | A * | 1/1977 | Herrick | 30/43.5 |
| 4,038,748 | A * | 8/1977 | Tyler | 30/43.6 |
| 4,077,120 | A * | 3/1978 | Herrick et al. | 30/43.5 |
| 4,168,570 | A * | 9/1979 | Bakker et al. | 30/43.6 |
| 4,698,908 | A * | 10/1987 | Bergsma et al. | 30/43.6 |
| 6,226,870 | B1 * | 5/2001 | Barish | 30/43.6 |
| 6,463,661 | B2 * | 10/2002 | Skipper | 30/74 |
| 6,823,590 | B2 * | 11/2004 | Uchiyama et al. | 30/43.6 |

FOREIGN PATENT DOCUMENTS

| | | | |
|---|---|---|---|
| EP | 1 452 281 | | 9/2004 |
| EP | 1637293 | A1 * | 3/2006 |
| JP | 2-14748 | | 4/1990 |
| JP | 02-252487 | | 10/1990 |
| JP | 2853812 | | 10/1990 |
| JP | 2005312523 | A * | 11/2005 |
| JP | 200687509 | A * | 4/2006 |

* cited by examiner

*Primary Examiner*—Jason Prone
(74) *Attorney, Agent, or Firm*—Koda & Androlia

(57) ABSTRACT

An electric rotary shaver including: a locking member (50) having a plurality of arms (54) outwardly extending from the center, a cutter retaining plate (38) that engages with outer circumferential rims of outer cutters (24) and rotatably holds inner cutters (32), guide pins (56) provided on the tip ends of the arms (54) and slidably pass through the cutter retaining plate (38), permanent magnets (62) fastened to the cutter frame (20) and attach the guide pins (56) by magnetic attraction in a detachable manner, compression coil springs (64) mounted on the guide pins (56) and provided in a compressed state between the arms (54) and the cutter retaining plate (38), and anchoring elements (66, 68) which prevents a locking member (50) from being separated from the cutter retaining plate (38) by more than a predetermined gap.

7 Claims, 8 Drawing Sheets

ELECTRIC ROTARY SHAVER

BACKGROUND OF THE INVENTION

1. Field of the Invention

The present invention relates to an electric rotary shaver which causes inner cutters to rotate while contacting substantially disk-form outer cutters, and uses the inner cutters to cut whiskers that are introduced into slits formed in the outer cutters.

2. Description of the Related Art

In electric shavers of this type, shavers that have a plurality of outer cutters are universally known. For example, such shavers include shavers in which two outer cutters are installed side by side in close proximity to each other, and shavers in which three outer cutters are disposed at the vertices of an equilateral triangle. In this structure, in order to improve the shaving characteristics, it is necessary to arrange the outer cutters so that these cutters are depressable and tiltable, thus causing the outer cutters to incline in conformity to the curvature of the shaving surface.

In the shaver disclosed in Japanese Patent No. 2853812, shaving units in which inner cutters are provided in outer cutters are mounted on a retaining plate, and this retaining plate is fastened to the inside wall of a cutter frame (holder). The retaining plate comprises a plurality of bayonet form arms that make an advancing and retracting motion from the center toward the outside. The tip ends of these arms are engaged with and disengaged from the inside wall surface of the cutter frame. Furthermore, the shaving units are mounted on the retaining plate from the side and are elastically held in a mounted state by elastic arms that are integrally formed on the retaining plate, so that the shaving units move slightly upward and downward.

Japanese Utility Model Application Publication (Kokoku) No. H2-14748 discloses a shaver in which the outer circumferential edges of outer cutters are pressed by retaining body (20) that holds inner cutters, and this retaining body (20) is pressed against a cutter frame via a spring. More specifically, a locking body (50) is detachably mounted on the cutter frame, and this locking body (50) has a plurality of anchoring rods that protrude in the radial direction; and these anchoring rods are engaged with or disengaged from the cutter frame by turning the locking body (50). Furthermore, the retaining body is pressed by a single spring (57) mounted in the center of the locking body (50).

FIG. 8 is a top view showing the internal structure of another conventional example of a cutter frame, and FIG. 9 is a sectional view taken along the line 9—9 in FIG. 8.

In this conventional example, three outer cutters 1 are disposed in a common outer cutter holder 2 so that these outer cutters are positioned at the vertices of an equilateral triangle, and the respective outer cutters 1 are anchored to the outer cutter holder 2 so as to be depressable and tiltable. Three inner cutters 4 are held in a holder 3 so that these inner cutters are rotated in a depressable and tiltable manner. Two projections 5 protrude from this inner cutter holder 3 for each outer cutter 1, with these projections being separated in the circumferential direction of the outer cutters 1 so that the projections do not interfere with the outer cutter holder 2.

The center of the inner cutter holder 3 is elastically supported on the cutter frame 7 by a locking bolt 6. More specifically, a nut 8 is inserted into the center of the cutter frame 7, and the inner cutter holder 3 and compression coil spring 11 are disposed between a knob 10 and a retaining ring 9 anchored to the locking bolt 6. Here, the inner cutter holder 3 is pressed against the retaining ring 9 (i.e., toward the tip end of the locking bolt 6) by the coil spring 11. Accordingly, if the tip end of the locking bolt 6 is screwed into the nut 8, the inner cutter holder 3 presses against the outer cutters 1 in an elastic manner by means of the coil spring 11. In other words, the circumferential edges of the outer cutters 1 are pressed by the coil spring 11 via the inner cutter holder 3 that is integrated with the projections 5.

When the cutter frame 7 is mounted on the shaver main body (not shown in FIGS. 8 and 9), the inner cutters 4 engage with the drive shafts (not shown in 8 and 9) of the shaver main body and are rotationally driven. These drive shafts advance and retract in the axial direction with a return habit in the direction of protrusion and elastically press the inner cutters 4 against the inside surfaces of the outer cutters 1. Furthermore, three supporting protrusions 12 (only one is shown in FIG. 9) that support the outer cutter holder 2 in the vicinity of the vertices of the triangular shape are provided to protrude from the shaver main body.

In the shaver described in Japanese Patent No. 2853812, the movable range (range of vertical movement and tilting range) of the shaving units comprising outer cutters and inner cutters is limited to the movable range of the elastic arms that are integrated with the retaining plate and is therefore unavoidably extremely small. Accordingly, the outer cutters cannot sufficiently conform to indentations and projections or variations in the inclination of the shaving surface (skin), and the shaving characteristics are therefore poor. Furthermore, when shaving debris is cleaned away, the arms that protrude outward from the center (toward the inside wall of the cutter frame) are pressed toward the center with the fingertips, so that the tip ends of the arms are disengaged from the inside wall of the cutter frame; accordingly, a fine operation using the fingertips is required, and the operating characteristics are poor.

In the shaver described in Japanese Utility Model Application Publication (Kokoku) No. H2-14748, the retaining plate (20) that holds the inner cutters is elastically pressed toward the outer cutters. Accordingly, vertical movement of the outer cutters can be accomplished by vertical displacement of this retaining plate. However, in order to remove the retaining plate for the purpose of cleaning away shaving debris, it is necessary to turn the locking body (50) with the fingertips, thus making the operating characteristics poor.

In the conventional example shown in FIGS. 8 and 9, a nut 8 into which the tip end of the locking bolt 6 is screwed is inserted into the cutter frame 7, and this part is surrounded by the outer cutter holder 2. Accordingly, it becomes necessary to broaden the spacing of the outer cutters in the vicinity of this nut 8; and in cases where three outer cutters are used, it is necessary to broaden the spacing of the respective outer cutters or to increase the diameter of the respective outer cutters. As a result, the size of the cutter frame tends to increase. Likewise, in cases where two outer cutters are used, it is necessary to broaden the spacing of the outer cutters, and this has been a serious problem. Furthermore, when shaving debris is cleaned away, the locking bolt 6 must be rotated with the fingertips. The operating characteristics are thus poor.

Furthermore, in the shavers disclosed in FIGS. 8 and 9 and in Japanese Utility Model Application Publication (Kokoku) No. H2-14748, the retaining body (20) or inner cutter holder (3) is pressed by a single coil spring (57, 11) in the center. More specifically, the retaining body (20) or inner cutter holder (3) is elastically pressed by a coil spring (57, 11) mounted on the locking body (50) or locking bolt (6) fastened to the center of the cutter frame.

However, in a shaver in which the retaining body (20) or inner cutter holder (3) is thus pressed by a single coil spring (57, 11) in the center, the retaining body (20) or inner cutter holder (3) tends to move in the radial direction when the outer cutters are pressed downward. In the case of the shaver described in Japanese Utility Model Application Publication (Kokoku) No. H2-14748, the locking body (50) is firmly fastened to the cutter frame by means of a plurality of anchoring rods (52) that protrude in the radial direction. Accordingly, the retaining body (20) is aligned with the central shaft (protruding pin 15) which is fastened at both ends to the cutter frame and the locking body (50), and the movement of this retaining body (20) in the radial direction is restricted.

Meanwhile, in the shaver shown in FIGS. 8 and 9, the tip end of the locking bolt 6 is screwed into a nut 8 that is embedded in the cutter frame, so that a so-called cantilever support is constructed. Accordingly, the locking bolt 6 tends to be unstable, and the inner cutter holder 3 that is held here is also unstable. Accordingly, two pins 13 (see FIG. 8) protrude from the cutter frame 7, and these pins 13 are passed through the inner cutter holder 3.

In such cases, however, since there is only a single coil spring, it is necessary to use a coil spring with a strong spring force. Consequently, the detachment operating characteristics of the locking body (50) or locking bolt (6) when shaving debris is cleaned away are poor. Furthermore, the structure used to position the retaining body (20) or inner cutter holder (3) in the radial direction becomes complicated.

BRIEF SUMMARY OF THE INVENTION

The present invention was devised in light of such facts.

It is an object of the present invention to provide an electric rotary shaver in which the movable range of the outer cutters can be increased, the spacing of the outer cutters can be narrowed so that the size of the cutter head can be reduced, the operation performed by the fingertips when shaving debris is cleaned away can be simplified, and the retaining plate or inner cutter holder can be stably held without complicating the structure.

The above object is accomplished by a unique structure of the present invention for an electric rotary shaver that includes:

a shaver main body that contains therein a motor, a cutter frame attached to the shaver main body, a plurality of circular outer cutters provided in the cutter frame, and a plurality of inner cutters that are provided insides of the outer cutters so as to be rotationally driven while being elastically pressed against the outer cutters by means of drive shafts that are rotationally driven by the motor; and in the present invention, the electric shaver further includes:

a cutter retaining plate which is provided inside of the cutter frame and engages with the outer circumferential edges of the outer cutters and rotatably holds the inner cutters;

a locking member which has a plurality of arms that extend outwardly from a center thereof with equal intervals in between in a circumferential direction of the locking member;

a plurality of guide pins which are provided at the tip ends of each one of the arms of the locking member and slidably pass through the cutter retaining plate;

permanent magnets which are provided on the cutter frame and attach the guide pins by magnetic attraction in a detachable manner;

a plurality of compression coil springs which are mounted on the guide pins and compressedly provided between the arms and the cutter retaining plate; and an anchoring means which prevents the locking member from being separated from the cutter retaining plate by more than a predetermined gap;

wherein the locking member and the cutter retaining plate are coupled together into an integral unit by the anchoring means so as to be detachable from the cutter frame.

The cutter retaining plate is movable while being guided by the plurality of guide pins and is elastically pressed toward the outer cutters by the compression coil springs mounted on the respective guide pins; accordingly, the movable range of the cutter retaining plate is sufficiently increased and large. Since the guide pins and permanent magnets are not provided in the center of the cutter frame, the adjacent outer cutters can be disposed in a sufficiently close proximity to each other so that the size of the cutter head is reduced.

Furthermore, in the present invention, the cutter retaining plate is pressed toward the outer cutters by a plurality of coil springs, and the locking member is fastened by means of permanent magnets; accordingly, when the locking member is to be removed, this locking member can be removed by a force equal to the difference between the spring force of the coil springs and the magnetic attachment force of the permanent magnets. Thus, the removal of the locking member can be accomplished with a light operating force. When the locking member is to be mounted back, since the locking member can be fastened in place merely by aligning the guide pins with the permanent magnets and applying a slight compression so that the coil springs are compressed by a fixed amount by the attachment force of the permanent magnets, the operation required is light and easy.

Furthermore, in the present invention, the plurality of guide pins that are used to fasten the locking member to the cutter frame are utilized, and the cutter retaining plate is guided by these guide pins; accordingly, it is not absolutely necessary to make the central shaft protrude from the center of the cutter frame and hold the cutter retaining plate here. The cutter retaining plate can be thus stably held without a complicated structure.

In the present invention, the cutter frame is provided with a central shaft that protrudes from the interior center of the cutter frame, and the center of the cutter retaining plate is engaged with this central shaft in a manner that the cutter retaining plate is slidable on the central shaft. With this structure, even when the outer cutters are depressed inward so that the cutter retaining plate sinks inward, the cutter retaining plate has much less tendency to move in the radial direction. Accordingly, the guide pins of the locking member tend not to be moved in relative terms with respect to the permanent magnets, and there is little danger that the guide pins will slip from the permanent magnets.

The outer cutters can be comprised of two outer cutters that are installed side by side or can be comprised of three or more outer cutters. In a shaver with three outer cutters, these three outer cutters and inner cutters are disposed at the vertices of an equilateral triangle, and the central shaft is disposed at the center of this triangular shape. In a shaver with two outer cutters that are disposed side by side, the central shaft is provided to be at an intermediate point between the two outer cutters.

The permanent magnets can be provided in substantially V-shaped grooves surrounded by the adjacent outer cutters and the inside wall of the cutter frame. With this structure, the spacing of the outer cutters is sufficiently small, and thus this arrangement is much more suitable for reducing the size of the cutter head of the electric shaver.

Inclined guide walls that are used to align the tip ends of the guide pins with the permanent magnets can be formed in the vicinity of the portions of the cutter frame to which the permanent magnets are attached. With this structure, strict positioning of the guide pins during the mounting of the locking member becomes unnecessary, thus improving the operating characteristics. It is preferable that these guide walls be formed as inclined surfaces that expand in the form of circular conical surfaces from the end surfaces of the permanent magnets. In these inclined surfaces, the portions on the external diameter side or the internal diameter side with respect to the center of the cutter frame can be left with other portions omitted. The reason for this is that centering of the locking member can be accomplished by the cooperative action of a plurality of guide walls.

Furthermore, a projection used to catch the fingers can be provided so as to surround the center of the cutter frame on the locking member. With this projection, attachment and detachment of the locking member are greatly facilitated. This projection used to catch the fingers can be split in the circumferential direction, and it also can be formed as a circumferentially continuous ring.

DETAILED DESCRIPTION OF THE INVENTION

Figure 1:
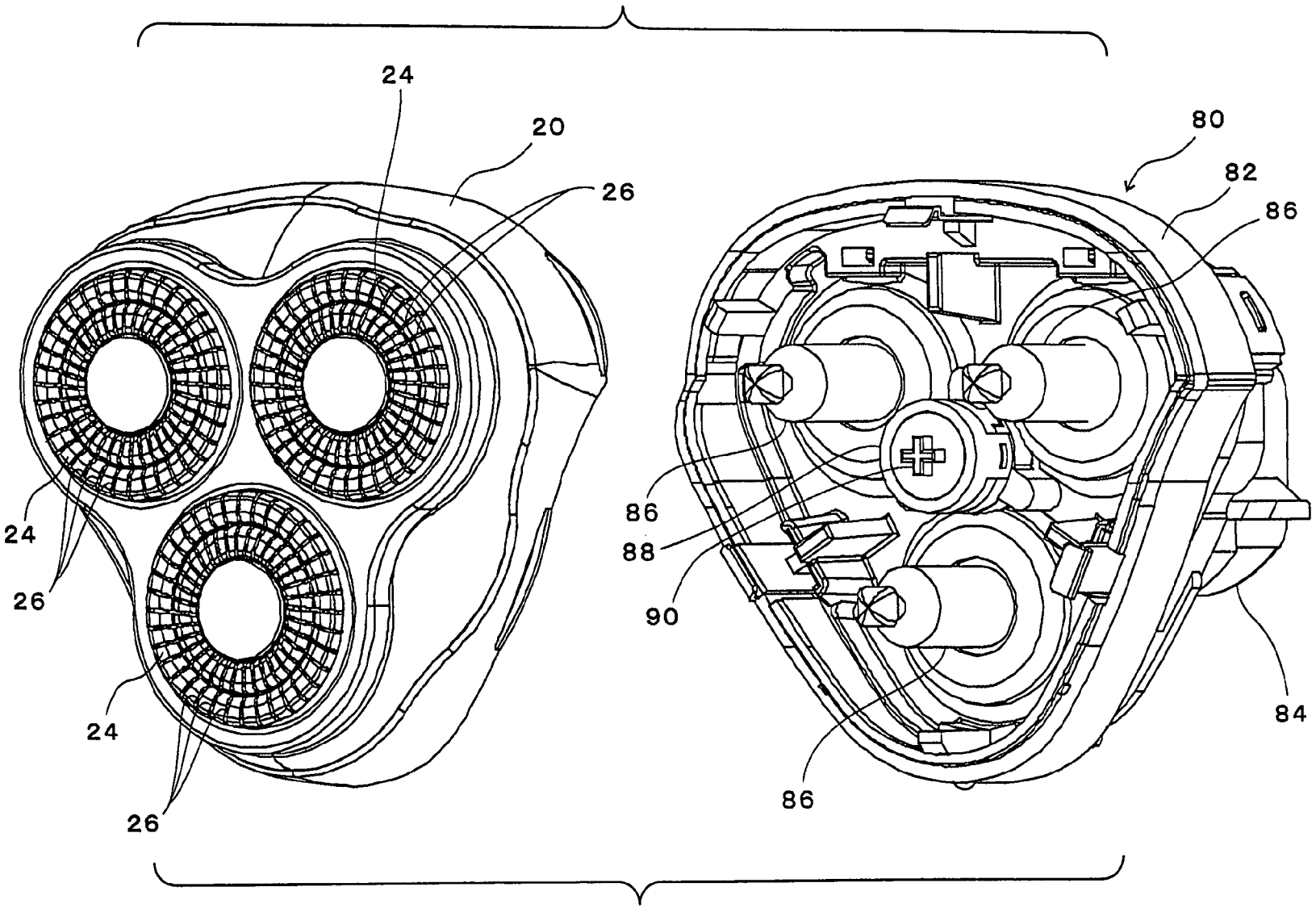
FIG. 1 is a perspective view of the cutter head and the driving section of the electric shaver according to one embodiment of the present invention.
Figure 2:
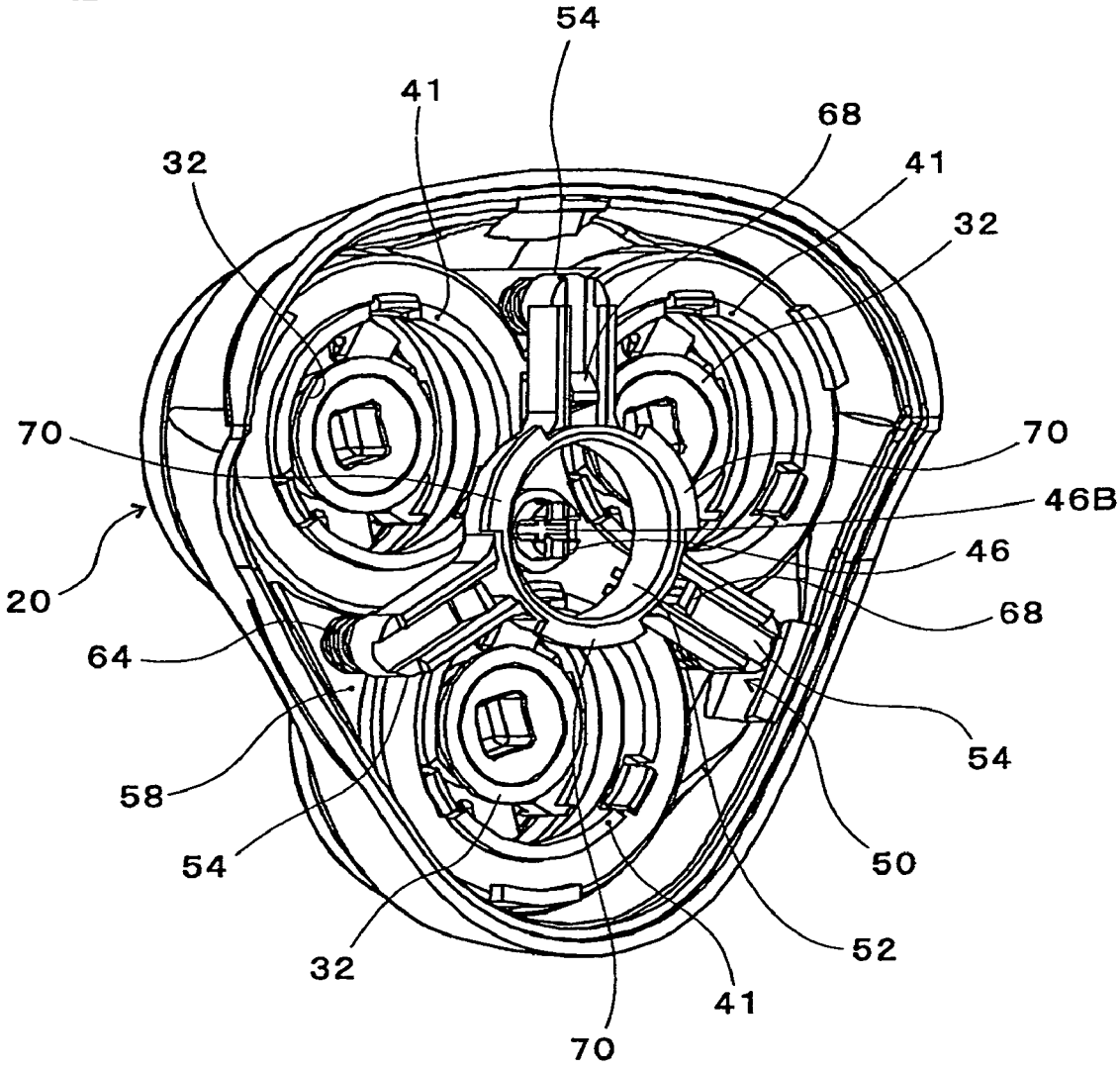
FIG. 2 is a perspective view of the cutter head showing the inside.
Figure 3:
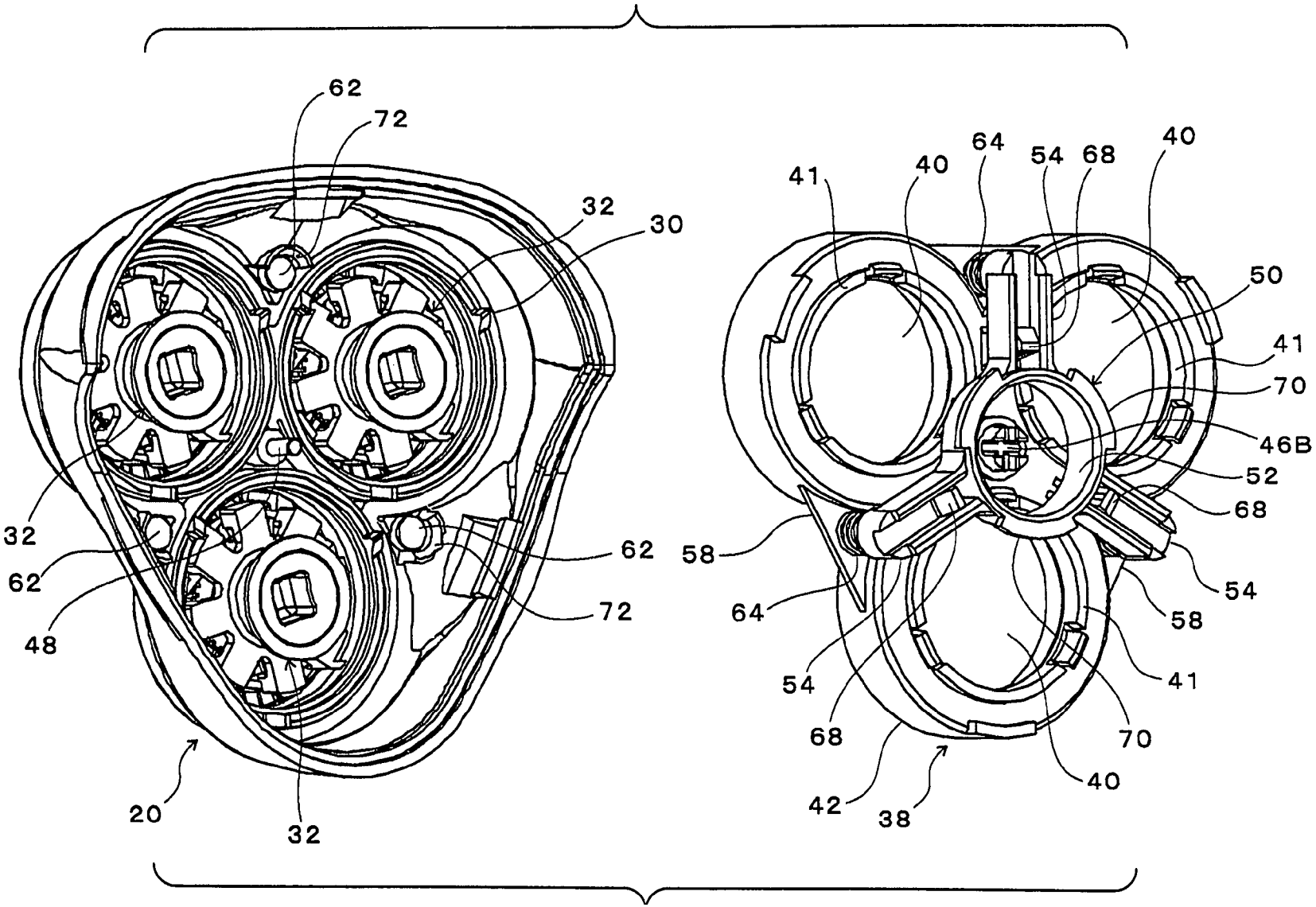
FIG. 3 is an exploded perspective view showing the state in which the cutter retaining unit is separated from the cutter head.
Figure 4:
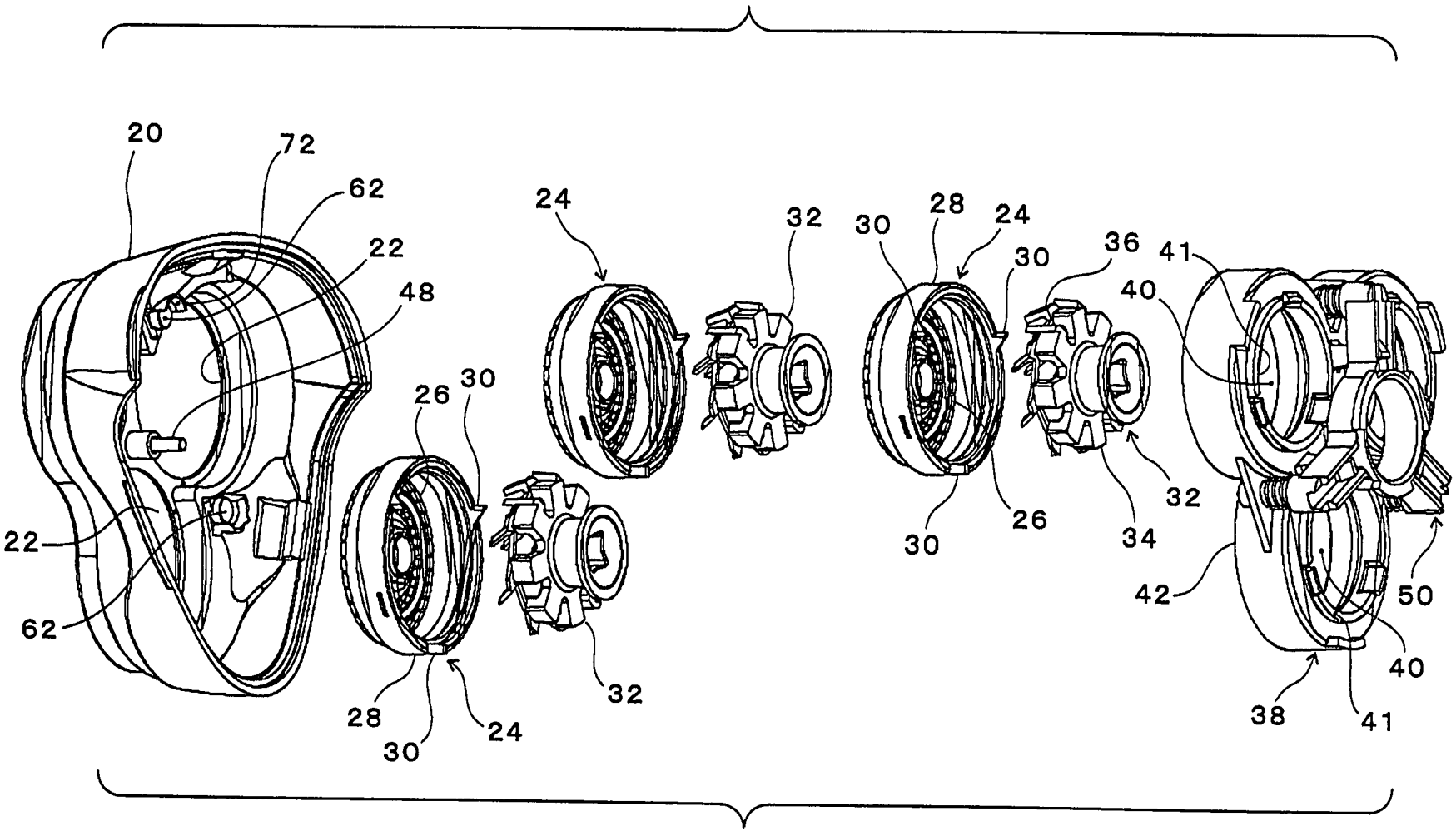
FIG. 4 is an exploded perspective view in which the outer cutters and inner cutters are separated.

In FIGS. 1 through 7, the reference numeral 20 indicates a cutter frame; three outer cutter mounting holes 22 (see FIGS. 4 and 7) are formed in the substantially triangular bottom surface (or top surface) of this cutter frame 20.

The reference numerals 24 indicate outer cutters. These outer cutters have a substantially circular disk form cap shape, and numerous slits 26 are formed in a radial configuration in the circular portions of these outer cutters, which are made of thin metal plates (see FIGS. 1 and 4). Annular outer circumferential rims 28 made of a synthetic resin are integrally fastened to the opening rims of the outer cutters 24, and three projections 30 are formed to protrude from the edges of these outer circumferential rims 28 at equal intervals in the circumferential direction so that they are in positions that are located slightly to the inside of the outer circumferential surfaces (see FIG. 4).

The reference numerals 32 indicate inner cutters. Each inner cutter 32 is comprised of an inner cutter base body 34 (see FIG. 4), which is made of a synthetic resin in which numerous arms extend radially from a cap-form base portion, and a ring-shaped cutter blade connecting body 36, which is fastened to the tip ends of the arms. In this cutter blade connecting body 36, numerous cutter blades that make sliding contact with the inside surface of the corresponding outer cutter 24 are integrally formed in an annular configuration.

The reference numeral 38 refers to a cutter retaining plate. In this cutter retaining plate 38, three openings 40 that correspond to the outer cutter mounting holes 22 of the cutter frame 20 are formed. Outer cutter driving rings 41 are inserted into these openings 40 so that these outer cutter driving rings 41 are free to rotate. In the shown embodiment, the shaving characteristics are improved by way of designing so that the outer cutters 24 are rotated at a lower speed than the inner cutters 32 and in the opposite direction from the inner cutters 32. Accordingly, gears are formed on the outer circumferences of the outer cutter driving rings 41, and a pinion 46 (described later) is engaged with these gears.

Figure 6:
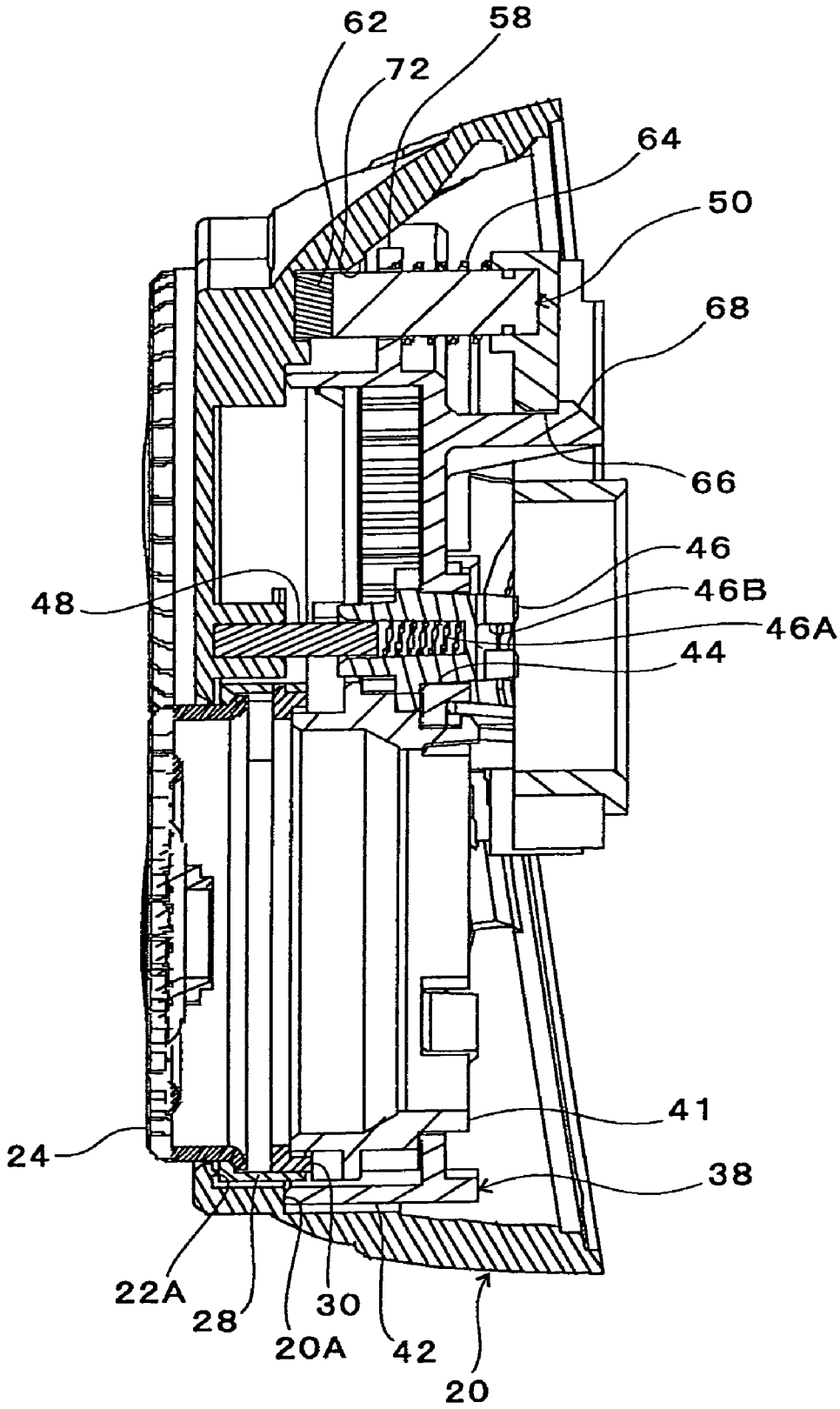
FIG. 6 is a longitudinal sectional side view of the cutter head.
Figure 7:
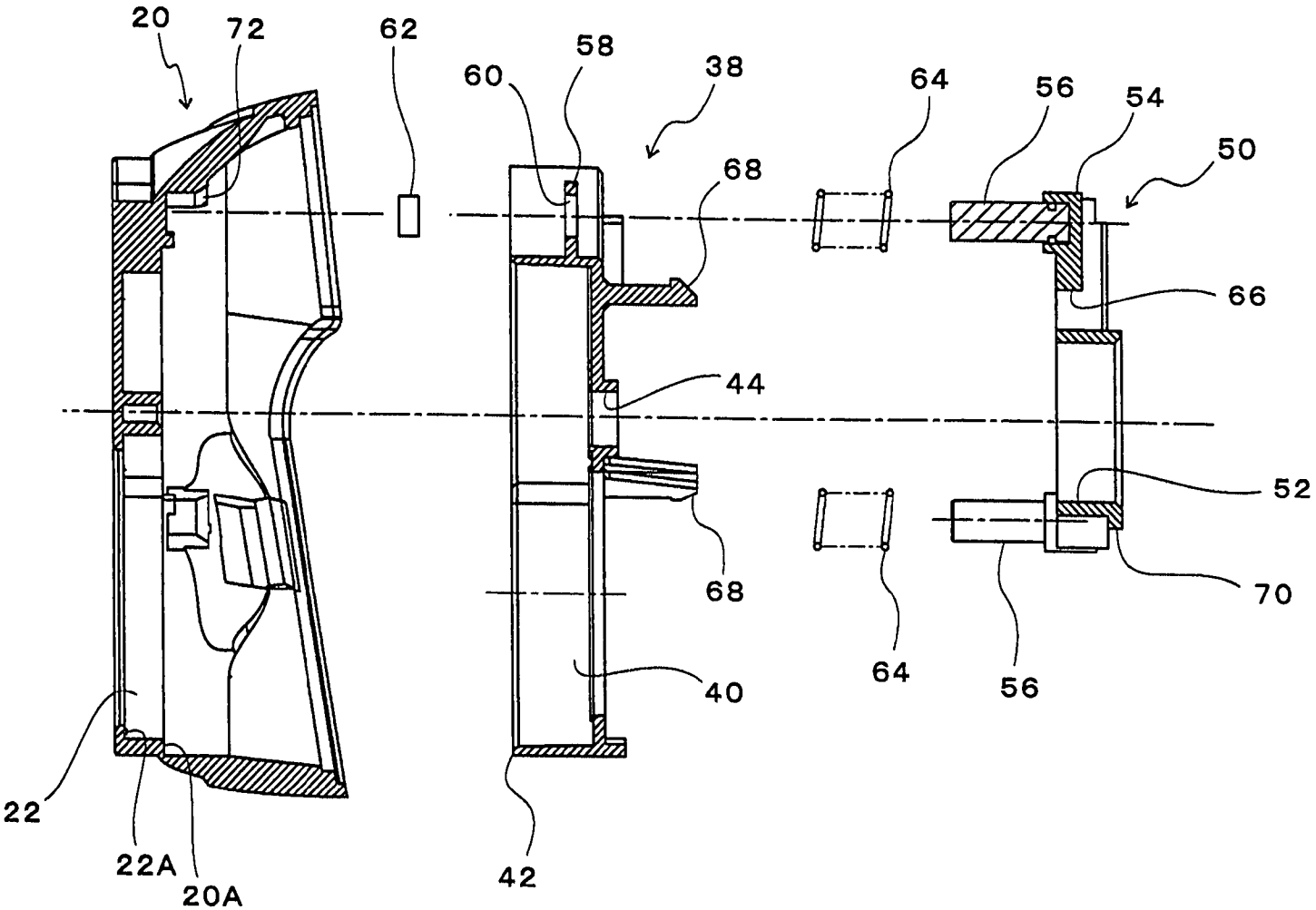
FIG. 7 is an exploded sectional view of the cutter retaining plate and the locking member.
Figure 8:
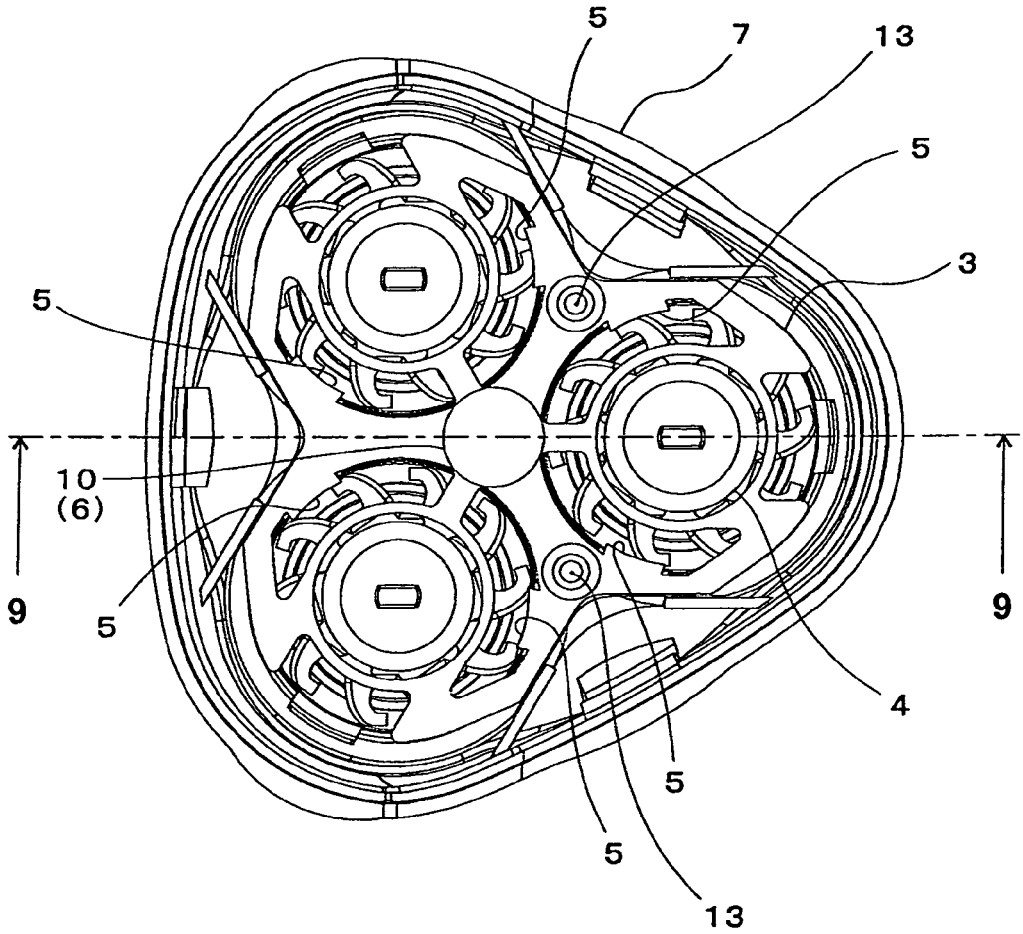
FIG. 8 PRIOR ART
FIG. 8 is a view showing the internal structure of a conventional cutter frame.
Figure 9:
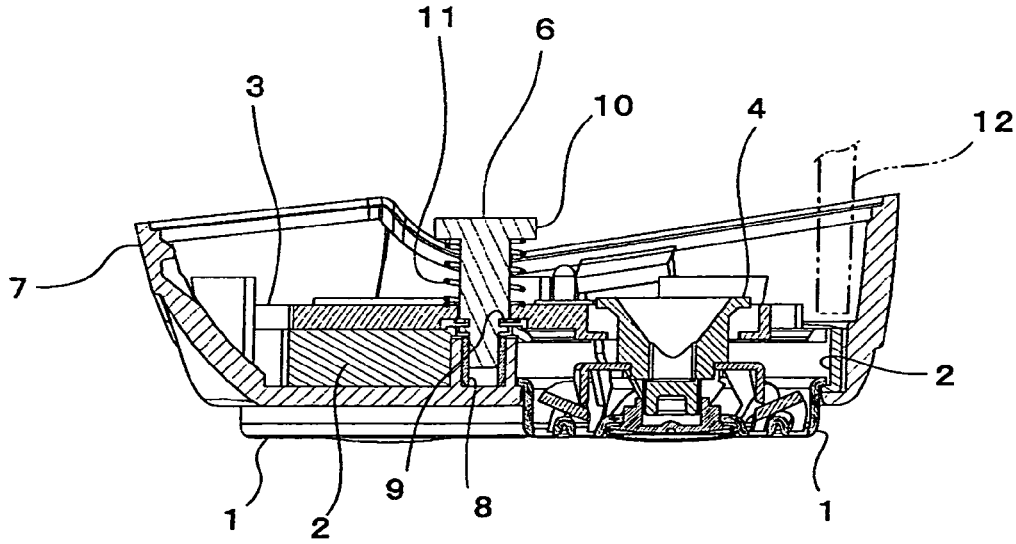
FIG. 9 PRIOR ART
FIG. 9 is a sectional view taken along the line 9—9 in FIG. 8.

In the assembled state shown in FIG. 6, the opening rims of the outer cutter driving rings 41 are engaged with the annular outer circumferential rims 28 of the outer cutters 24. The projections 30 on these outer circumferential rims 28 engage with the end surfaces of the outer cutter driving rings 41, so that the outer circumferential rims 28 and outer cutters 24 rotate as an integral unit together with the outer cutter driving rings 41.

The inner cutters 32 are provided so that they can be mounted insides of the outer cutter driving rings 41 and so that the inner cutters 32 are rotated in a depressable and tiltable manner inside these outer cutter driving rings 41. A substantially cloverleaf-shaped protruding walls 42 which surrounds the openings 40 is formed on the surface of the cutter retaining plate 38 that is located on the outer cutters 24 side, and the outer cutter driving rings 41 are mounted inside of this protruding wall 42. The protruding wall 42 is positioned so as to contact a step portion 20A (see FIG. 6) formed in the inside wall of the cutter frame 20.

Figure 5:
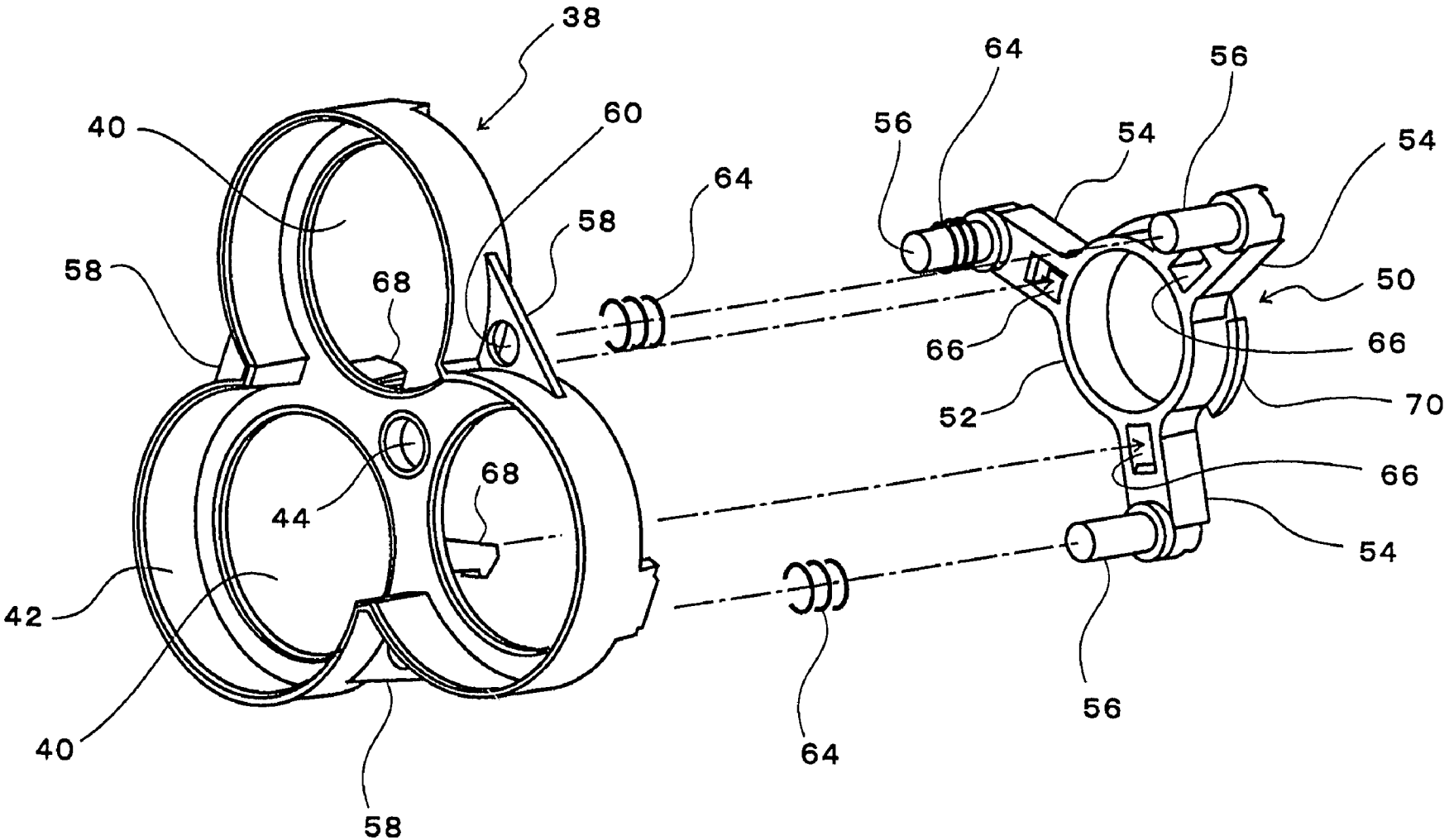
FIG. 5 is an exploded perspective view of the cutter retaining unit.

As seen from FIG. 5, a small opening 44 is formed in the center of the cutter retaining plate 38, and a pinion (small gear) 46 is held rotatably in this small hole 44 (see FIG. 6). This pinion 46 is rotationally driven at a low speed by an outer cutter drive shaft 88 (described later) and engages with the outer circumferences of the outer cutter driving rings 41 as described above. A central shaft 48 that is provided to protrude from the center of the inside surface of the cutter frame 20 is inserted in an aperture of this pinion 46. The pinion 46 and central shaft 48 help positioning the cutter retaining plate 38 when the cutter retaining plate 38 is mounted, and they also have the effect of restricting the movement of the cutter retaining plate 38 in the radial direction when the outer cutters 24 are pressed inward and of preventing the permanent magnets 62 and guide pins 56 (described later) from slipping out of position.

A coil spring 46A is installed in the insertion hole of the pinion 46 into which the central shaft 48 is inserted (see FIG. 6). In the assembled state of the cutter frame 20 and cutter retaining plate 38, this coil spring 46A is compressed between the central shaft 48 and the pinion 46, and thus endows the pinion 46 with a return habit that causes the pinion 46 to return toward the outer cutter drive shaft 88 (described later) in an elastic manner.

The reference numeral 50 indicates a locking member. As shown in FIGS. 1 through 4, the locking member 50 has three arms 54 that extend radially or outwardly at intervals of 120° in the circumferential direction from a central circular ring portion 52. Respective guide pins 56 are installed in an upright position with reference to the arms 54 on the tip ends of the three arms 54 so that the pins 56 face the cutter frame 20. The guide pins 56 are made of a metal that is attached to (or attracted by) the permanent magnets 62 (described later) by magnetic attraction, e.g., a soft magnetic material such as iron, permalloy or the like.

In a state in which the center of the circular ring portion 52 is aligned with the center of the cutter retaining plate 38 (the center corresponding to the position of the small opening 44), the three arms 54 of the locking member 50 extend radially through the spaces between the adjacent outer cutters 24. Substantially triangular small plates 58 which fill three V-shaped troughs abutted by the protruding wall 42 that surrounds the adjacent openings 40 are integrally formed on the cutter retaining plate 38. Guide holes 60, which have a slightly larger diameter than the guide pins 56 of the locking member 50 and allow sliding movement of these guide pins 56, are formed in the respective small plates 58.

Circular disk-form permanent magnets 62 are respectively fastened by means of an adhesive agent or the like to the cutter frame 20 in three positions that face the guide holes 60. In other words, the permanent magnets 62 are respectively provided in three V-shaped gaps surrounded by the adjacent outer cutters 24 and the inside wall of the cutter frame 20. In a state in which the three guide pins 56 of the locking member 50 are passed through the three guide holes 60 of the cutter retaining plate 38, these permanent magnets 62 attach or attract the tip ends of the guide pins 56 by magnetic attraction.

The reference numerals 64 are coil springs that are mounted on the guide pins 56. These three compression coil springs 64 are compressed between the arms 54 of the locking member 50 and the triangular small plates 58 of the cutter retaining plate 38.

Engaging holes 66 which pass through parallel to the guide pins 56 are respectively formed in the respective arms 54 of the locking member 50. Three engaging claws 68 which are engageable with and disengageable from these engaging holes 66 are formed to protrude from the cutter retaining plate 38. These engaging claws 68 advance into and engage with the engaging holes 66 of the arms 54 when the locking member 50 is assembled with the cutter retaining plate 38. As a result, these engaging holes 66 and engaging claws 68 form an anchoring means that prevents the locking member 50 from being separated from the cutter retaining plate 38 by more than a predetermined gap and at the same time allows these two parts to approach each other.

The predetermined gap, which is formed between the locking member 50 and the cutter retaining plate 38 when the engaging claws 68 are engaged with the engaging holes 66, has a dimension in which the coil springs 64 mounted on the guide pins 56 are clamped and slightly compressed between the arms 54 and small plates 58. Furthermore, a flange-form projection 70 used to catch the fingers is integrally formed on the circular ring portion 52 of the locking member 50. The projection 70 is split into three sections in the circumferential direction.

Inclined guide walls 72 (see FIGS. 2, 3 and 6) that guide the tip ends of the guide pins 56 to the correct positions when the tip ends of these guide pins 56 are attached by magnetic attraction to the permanent magnets 62 are formed on the portions of the cutter frame 20, to such portions the permanent magnets 62 being fastened. These guide walls 72 are inclined surfaces that expand outward in a circular conical form from the end surfaces of the permanent magnets 62. The guide walls 72 need not be complete circular conical surfaces, and they can be surfaces with some portions cut away. For example, the guide walls can be formed as walls in which the internal diameter side is removed and only the external diameter side is left with respect to the center of the cutter frame 20. In this structure, the three permanent magnets 62 and guide walls 72 act in conjunction to guide the three guide pins 56 and correctly position the locking member 50.

In FIG. 1, a driving section 80 is an integral part of the shaver main body (not shown in FIG. 1). This driving section 80 comprises a substantially triangular base plate 82, a single-driving motor 84 which is attached to the back surface of this base plate 82, three drive shafts 86 that protrude on the front surface side from positions at the vertices of the triangle of the base plate 82, and the outer cutter drive shaft 88 that protrudes on the front surface side from the center of the base plate 82.

The three drive shafts 86 are rotationally driven by rotating shaft (not shown) of the driving motor 84. The drive shafts 86 are endowed with a return habit in the direction of protrusion by coil springs (not shown). The outer cutter drive shaft 88 contains a speed reduction mechanism made of a planetary gear and is rotationally driven at a low speed by the rotating shaft of the motor 84.

A cruciform protruding portion 90 is formed on the end surface of the outer cutter drive shaft 88. The protruding portion 90 engages with a cruciform recessed portion 46B (see FIGS. 2, 3 and 6) formed in the tip end of the pinion 46 when the cutter head is assembled with this driving section 80. The pinion 46 is movable toward the cutter frame 20 by the compression of the coil spring 46A installed in the pinion 46. Accordingly, when the cutter head and driving section 80 are assembled, the pinion 46 is pressed inward if the engagement of the cruciform protruding portion 90 and recessed portion 46B is not properly aligned, and the pinion 46 returns when the protruding portion 90 and recessed portion 46B are engaged as a result of the rotation of the outer cutter drive shaft 88.

Next, the operation of the embodiment described above will be described.

First, the outer cutters 24 are mounted in the outer cutter mounting holes 22 of the cutter frame 20, and the outer circumferential rims 28 of the outer cutters 24 are brought to be engaged with the step portion 22A of the cutter frame 20. Then, the inner cutters 32 are mounted in the outer cutters 24.

Meanwhile, the outer cutter driving rings 41 and locking member 50 are assembled with the cutter retaining plate 38 to form a cutter retaining unit. More specifically, the coil springs 64 are first mounted on the guide pins 56, and the guide pins 56 are next inserted into the guide holes 60 of the cutter retaining plate 38. Then, when the engaging claws 68 of the cutter retaining plate 38 are engaged with the engaging holes 66 of the locking member 50, the cutter retaining plate 38 and locking member 50 are integrated to form the cutter retaining unit. The cutter retaining unit is grasped by engaging the fingertips of the thumb and index finger with the projection 70 (used to catch the fingers) of the locking member 50, and the guide pins 56 are brought to be attached by magnetic attraction to the permanent magnets 62 of the cutter retaining plate 38.

During this mounting process, the guide walls 72 located in close proximity to the end surfaces of these permanent magnets 62 correctly guide the tip ends of the guide pins 56 to the permanent magnets 62, so that the above-described cutter retaining unit can be set in the correct position. In this state, the cutter retaining plate 38 presses the projections 30 of the outer cutters 24 while compressing the coil springs 64. Furthermore, a state in which the engaging claws 68 of the cutter retaining plate 38 float slightly upward from the engaging holes 66 of the locking member 50 is produced, so that the cutter retaining plate 38 is allowed to move relative to the locking member 50. In this case, furthermore, the central shaft 48 advances into the pinion 46, and the coil spring 46A is compressed.

The cutter head thus assembled is mounted on the shaver main body 80. When the cutter head is thus mounted, the drive shafts 86 driven by the motor is brought to be engaged with the inner cutters 32 so that the inner cutters 32 are rotated. Furthermore, the protruding portion 90 of the outer cutter drive shaft 88 comes to engage with the recessed portion 46B of the pinion 46, so that the outer cutter driving rings 41 can be rotated at a low speed in the opposite direction from the drive shafts 86. The outer cutters 24 are rotated at a low speed together with the outer cutter driving rings 41.

When, during shaving, the outer cutters 24 contact the skin and are depressed, and the outer cutters 24 press the outer cutter driving rings 41 and cutter retaining plate 38 downward toward the cutter main body. The cutter retaining plate 38 is moved toward the locking member 50 while compressing the coil springs 64 and being guided by the guide pins 56 and center shat 48. When, on the other hand, the external force that depresses the outer cutters 24 is eliminated, the cutter retaining plate 38 is pushed back (pressed upward) by the coil springs 64 and is pressed by the outer cutter driving rings 41 so that the cutter retaining plate 38 returns to its original position (the position shown in FIGS. 1 and 6).

When the shaving debris is to be cleaned away, the projection 70 (used to catch the fingers) of the locking member 50 is grasped with the fingers, and a unit that consists of the locking member 50 and cutter retaining plate 38 (i.e., a cutter retaining unit) is pulled away from the cutter frame 20. In this case, since the rebound force of the coil springs 64 that contact the small plates 58 of the cutter retaining plate 38 at one end acts on the locking member 50 in a direction that pulls the locking member 50 away, the cutter retaining unit can be removed by a force that is smaller than the magnetic attraction attachment force of the permanent magnets 62.

When the cutter retaining unit is thus removed, the inner cutters 32 and outer cutters 24 remain and are revealed inside the cutter frame 20; and these cutters can be cleaned. If necessary, it is possible to remove the inner cutters 32, so that the inner cutters 32 and the outer cutters 24 that are separated from each other are cleaned.

In the above structure, the electric rotary shaver has three outer cutters and inner cutters so that they are positioned at vertices of an equilateral triangle, and the central shaft is positioned at the center of the equilateral triangle. The present invention is also applicable to an electric rotary shaver that has two sets of outer and inner cutters disposed side by side. In this structure, the central shaft of the cutter frame is positioned at an intermediate point between the two outer cutters; and other structures are designed so as to comply with this two outer and inner cutter structure, so that, for instance, the cutter frame 20 is formed with two outer cutter mounting holes 22, the cutter retaining plate 38 has two openings 40, the locking member 50 has two arms 54, and two drive shafts 86 are provided.

The invention claimed is:

1. An electric rotary shaver comprising:

a shaver main body that contains therein a motor, a cutter frame attached to said shaver main body, a plurality of circular outer cutters provided in said cutter frame, and a plurality of inner cutters are provided inside of said outer cutters so as to be rotationally driven while being elastically pressed against the outer cutters by drive shafts that are rotationally driven by said motor;

said electric shaver further comprising:

a cutter retaining plate which is provided inside of said cutter frame and engages with outer circumferential edges of said outer cutters and rotatably holds said inner cutters, a locking member which has a plurality of arms that extend outwardly from a center thereof with equal intervals in between in a circumferential direction of the locking member, a plurality of guide pins which are provided at tip ends of each one of said arms of said locking member and slidably pass through said cutter retaining plate, permanent magnets which are provided on said cutter frame and attach said guide pins by magnetic attraction in a detachable manner, a plurality of compression coil springs which are mounted on said guide pins and compressedly provided between said arms and said cutter retaining plate, and an anchoring means which prevents said locking member from being separated from said cutter retaining plate by more than a predetermined gap; and wherein said locking member and said cutter retaining plate are coupled together into an integral unit by said anchoring means so as to be detachable from said cutter frame.

2. The electric rotary shaver according to claim 1, wherein said the cutter frame is provided therein with a central shaft so that the central shaft is located between mutually adjacent outer cutters, and said cutter retaining plate is slidably engaged with said central shaft.

3. The electric rotary shaver according to claim 2, wherein three outer cutters and inner cutters are disposed so as to be positioned at vertices of an equilateral triangle, and said central shaft is positioned at a center of said equilateral triangle.

4. The electric rotary shaver according to claim 2, wherein two outer cutters and inner cutters are disposed side by side, and said central shaft is positioned at an intermediate point between the two outer cutters.

5. The electric rotary shaver according to claim 1, wherein the permanent magnets are provided in substantially V-shaped gaps between adjacent outer cutters and an inner wall of the cutter frame.

6. The electric rotary shaver according to claim 1, wherein inclined guide walls that align tip ends of said guide pins with said permanent magnets are formed in a vicinity of where said permanent magnets are provided in said cutter frame.

7. The electric rotary shaver according to claim 1, wherein said locking member is provided with a circular ring portion in a center thereof, and a projection is formed on said circular ring portion.

* * * * *